US007288291B2

(12) United States Patent
Maijala et al.

(10) Patent No.: US 7,288,291 B2
(45) Date of Patent: Oct. 30, 2007

(54) METHOD FOR FORMING A FILM, BY USING ELECTROSTATIC FORCES

(75) Inventors: Juha Maijala, Tampere (FI); Johan Grön, Espoo (FI); Kaisa Putkisto, Tampere (FI); Vilho Nissinen, Numminen (FI); Pentti Rautiainen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 183 days.

(21) Appl. No.: 10/507,437

(22) PCT Filed: Mar. 11, 2003

(86) PCT No.: PCT/FI03/00182

§ 371 (c)(1),
(2), (4) Date: Jan. 24, 2005

(87) PCT Pub. No.: WO03/076083

PCT Pub. Date: Sep. 18, 2003

(65) Prior Publication Data

US 2005/0123777 A1 Jun. 9, 2005

(30) Foreign Application Priority Data

Mar. 14, 2002 (FI) ..... 20020479
May 28, 2002 (FI) ..... 20020998

(51) Int. Cl.
*B05D 1/06* (2006.01)

(52) U.S. Cl. ..... 427/482; 427/475; 427/477

(58) Field of Classification Search ..... 427/475, 427/477, 482

See application file for complete search history.

(56) References Cited

U.S. PATENT DOCUMENTS

| | | | | |
|---|---|---|---|---|
| 3,521,558 | A * | 7/1970 | Patterson et al. | 101/114 |
| 3,549,403 | A * | 12/1970 | Barbehenn et al. | 427/471 |
| 3,680,779 | A * | 8/1972 | Reilly | 239/3 |
| 3,930,614 | A | 1/1976 | Krenkel | |
| 4,296,142 | A | 10/1981 | Vasudevan et al. | |
| 4,597,533 | A * | 7/1986 | Shirai et al. | 239/701 |
| 4,826,703 | A * | 5/1989 | Kisler | 427/469 |
| 5,344,082 | A | 9/1994 | Haller et al. | |
| 5,731,043 | A | 3/1998 | Horinka et al. | |
| 6,680,086 | B1 | 1/2004 | Nissinen et al. | |
| 7,186,445 | B2 * | 3/2007 | Putkisto et al. | 427/482 |

FOREIGN PATENT DOCUMENTS

DE 26 46 798 A1 4/1978

(Continued)

OTHER PUBLICATIONS

Powder Coatings The Complete Finishers Handbook, ed. by N.P. Liberto, 1994, pp. 86-89.*

(Continued)

*Primary Examiner*—Fred J. Parker
(74) *Attorney, Agent, or Firm*—Stiennon & Stiennon

(57) ABSTRACT

A film is formed on a planar surface by applying a granular layer on the planar surface by using electrostatic forces, and then finishing the granular layer to form the film. A converting line may be rebuilt to have devices employing this method. A multilayer sheet-like product comprising a film layer may be produced.

15 Claims, 1 Drawing Sheet

FOREIGN PATENT DOCUMENTS

| | | | |
|---|---|---|---|
| DE | 196 32 899 | A1 | 2/1998 |
| EP | 0 782 934 | A1 | 4/1996 |
| GB | 1 285 551 | | 8/1972 |
| GB | 1 328 238 | | 8/1973 |
| WO | 97/36049 | A1 | 10/1997 |
| WO | WO 02/45869 | A1 | 6/2002 |
| WO | 03/076715 | A2 | 9/2003 |
| WO | WO 03/076083 | A1 | 9/2003 |

OTHER PUBLICATIONS

International Search Report issued in PCT/FI03/00182.
International Preliminary Examination Report issued in PCT/FI03/00182.
English translation of Abstract in DE 196 32 899.

* cited by examiner

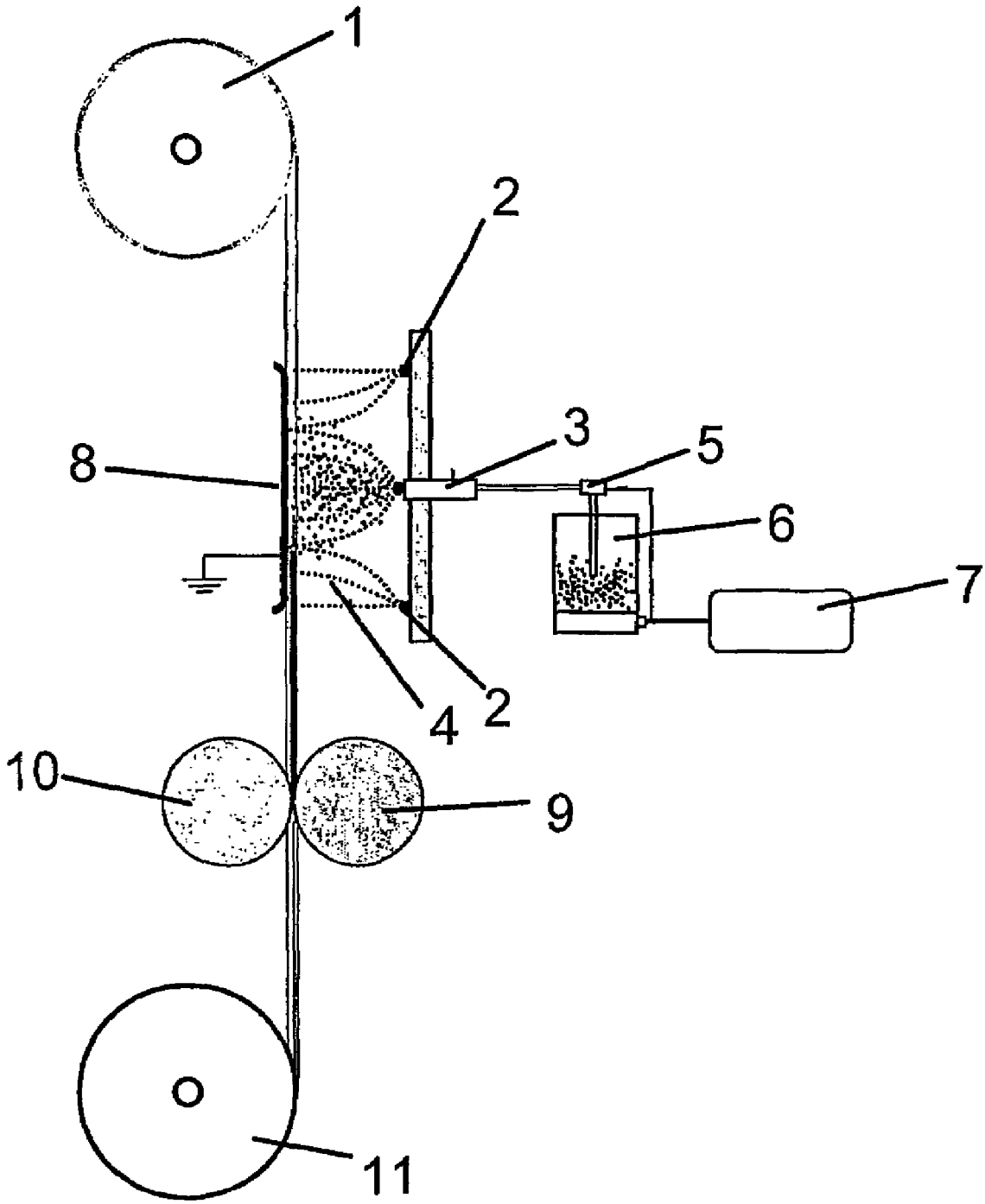
1
2
3
5
8
6
7
4
2
10
9
11

METHOD FOR FORMING A FILM, BY USING ELECTROSTATIC FORCES

CROSS REFERENCES TO RELATED APPLICATIONS

This application is a U.S. national stage application of International App. No. PCT/FI03/00182, filed Mar. 11, 2003, and claims priority on Finnish App. No. 20020479, Filed Mar. 14, 2002, and Finnish App. No. 20020998, Filed May 28, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for forming a film on a planar surface, a device for forming a film on a planar surface, a method in rebuilding a converting line comprising means for forming a film on a surface of a sheet-like substrate and a multilayer sheet-like product comprising a film layer. The term planar surface means in this application either a surface of a sheet-like substrate or a counter surface on which surface the film is formed and peeled off after forming. In other words, the latter product is a film without the substrate. The sheet-like substrate means that the substrate is of a sheet material, for example paper, polymeric film or metal film. The substrate can be either in a sheeted form or as a continuous web, preferably it is as a continuous web. The counter surface can be for example an endless belt on which surface the film is formed.

The known methods for forming a film include processes for forming a continuous film web, such as the extrusion process, or processes for forming a film on a sheet-like substrate, such as suspension coating, solvent-base coating and extrusion coating (and lamination). The suspension coating can be used for production of barrier coatings and intermediate layers for wet and dry lamination. In spread coating the coat weight (or applied amount) is adjusted on the web by doctoring, and by roll application the coat weight can be adjusted prior to the application (e.g. gravure applicator). The web requires drying afterwards.

Wet lamination, in which water-based suspensions with dry contents of 40-50% are mostly used, can be utilized to produce laminates such as aluminum foil/adhesive/paper or plastic film/adhesive/paper. Typical adhesives are casein, sodium silicate, starch, and latex (PVAc+EVAc, SB, PE or acrylates).

In dry lamination the water-based adhesive suspension is pre-dried on the web and then laminated with heat. Typically used polymers are hardening (curable) polyurethanes, PVDC, modified SB and acrylic copolymers.

Important properties of polymer dispersion films are barrier properties, for instance the film shall not permeate water or steam, odor, taste, grease, fat, oil, gases such as oxygen, light, or radiation, such as UV radiation. Other required properties may be that it shall be printable, durable against rubbing, puncture and chemicals, and heat sealable. The polymer dispersion films are used for different packages (food/non-food) and wrappings (paper wrappings, bags and kraft paper sacks).

Solvent-base coating can also be used for preparation of wet and dry laminated webs. The process requires solvent evaporation, recovery and recirculation.

The solvent acts as a plasticizer within the polymer during drying, which will change the polymer crystal structure, often weakening its barrier properties. Additionally, there is a risk for residual solvent in the product. Solvent-base coating is used especially for PVDC-based copolymers and restrictedly for coating plastic films, e.g. PET.

The extrusion process involves melting and application of a thin polymer film onto the substrate or between webs. Multilayer application and double-sided coating are possible. The layer thickness produced at a time is approx. 5-100 μm.

The most common coatings are PE-LD, acid-modified copolymers, or polyethylene blends with thermosets or ionomers, Ionomers are especially used on metal surfaces.

Important properties of extrusion coated products are adhesion to the substrates, odor and taste, pinhole-free structure, no curling, barrier properties, heat sealability and coefficient of friction. The extrusion coated films are used in liquid packaging, other rigid packaging (folding cartons, cup boards, ovanable boards), industrial applications (wrapping for paper reels and sawn timber, reel end discs, ream wrappers, paper sacks, building materials), flexible packaging (food, also pet food), photographic papers (phototypesetting, graphic arts and monochrome photography).

There are several defects, which relate to the techniques of the prior art. The defects of the prior art are discussed together with the advantages of the present invention.

SUMMARY OF THE INVENTION

The present invention is a replacement for the known film forming techniques. The method of the invention is characterized in that a granular layer is applied on the planar surface by using electrostatic forces, and the granular layer is finished to form the film. The device of the invention is characterized in that it comprises means for charging and applying a powdery film forming material on the planar surface as a granular layer, and means for finishing the granular layer. The rebuilding method is characterized in that the existing means for forming the film on the surface of the sheet-like substrate are replaced by a device comprising means for charging and applying a powdery film forming material on the substrate as a granular layer, and means for finishing the granular layer. The sheet-like product is characterized in that the film layer has been formed by applying a granular layer on the surface of the substrate by using electrostatic forces, and the granular layer has been finished to form the film.

The term granular layer means in this context a layer formed of powdery particles of the powdery film forming material. The term finishing means a process step in which the granular layer is converted into the film. In other words, in the mentioned process step the porous granular layer turns into the pinhole-free film.

The general advantages of the present invention are:

- since the powder is applied in a dry form no drying is required,
- the polymer properties do not suffer from an aggressive thermal treatment, because no long-term pre-melting steps are required and the process is fast,
- it is possible to modify the density and the composition of the film,
- impermeable structure and good coverage of the film is achieved even by low amounts of the applied material,
- low amount of waste,
- flexibility of the processing line, substrates and the materials of the film, modified surface properties are easily achieved, the same system can be used for different materials with a small grade change time, no waiting or aging time before using the produced material as in the solventless lamination process, the rate and degree of polymer crystallization can be modified, and the production efficiency of the dry surface treatment process is up to 1200 m/min (the maximum speed of the methods of the prior art: the off-line extrusion 600-800 m/min, the spread coating 800 m/min)

Advantages of the dry surface treatment over the conventional extrusion process can be found both in the fields of technical solutions and material handling. The same powder deposition unit suits for application of a variety of powders of different source and for manufacture of various products. Possibly changes of the supply systems and application geometries are necessary but the material-specific dies or screws are avoided such as required in extrusion. Through the air-borne powder supply, even hard and coarse pigment particles can be added in, which in extrusion might cause wearing of the screw section, and are used only in limited amounts. Then also specially optimized production variables are required (e.g. line speed). The overall maintenance work is low, because the powder-formed materials can be changed relatively fast without extensive control adjustments in the conversion operations. In extrusion the screw requires cleaning operations, i.e. purging with a low-viscosity polymer when cooling down or changing the material.

Advantages over extrusion include the short duration of melt processing. Also complex flow channels are avoided. In extrusion, due to the longer melt period, the material can suffer from temperature differences causing changes in the melt fluidity, possibly material solidification or polymer degradation and therefore problems in pumpability. Temperature differences can also impair interlayer adhesion in coextrusion. In a fast thermomechanical treatment the deforming polymer is not drawn or stretched as extensively as in extrusion (lower shear rates in the nip), so the stress relaxation-related problems afterwards are lesser. In the sintered products the low residual stress restricts the post-treatment shrinkage. In comparison, the resulting polymer film drawn at the extruder die is very material-specific and can therefore have irregularities such as uneven thickness profile (neck-in), melt fracture (the melt sticks to the die) and problems in adhesion (control of oxidation in the air gap). In coextrusion, the different viscosities of the layers can cause problems by interflow, unevenness and thickness variations.

Advantage over solvent-based coatings is that there will be no residual solvents in the product, especially when the materials are chosen so that there are none or only low content of volatile plasticizers that are released during heating. High efficiency of the process relates to the low amounts of waste during start-up and conversion operations and low extent of edge cutting. There are possibilities for material recovery and recycling, as the excess powder can be removed before fixation. Also the risk of entrapped air in the laminate is low after the fixation nip(s).

Since the process consists of the application, fixing and surface modification steps without intermediate drying or preliminary melting, the converting unit is very compact. In addition, the manufacture of multilayer structures simplifies, because no special equipments (coextrusion die) or extra extruders or application units are needed. On the contrary to the dry surface treatment process, drying capacity and recovering systems are energy-intensive and require large-scale investments in processes of the prior art.

The dry surface treatment process is environmentally safe. An eliminated water or solvent usage in the surface treatment process combined with more gentle melt processing are the main environment-related advantages. The reduction of energy consumption can also be achieved since the evaporation step is eliminated and no after-drying section is needed.

The dry surface treatment process of different substrates comprises the dry powder application followed by thermomechanical fixing in at least one heated roll nip. The coated and laminated products can be composed of layers of paper or board, plastic films, metal foils or metalized films, treated either one or double-sided with the dry surface treatment process. The application of the powdery film forming material utilizes an electric field to transfer the particles to the substrate surface to form a granular layer and to enable an electrostatic adhesion prior to the thermal treatment. Both the final adhesion and the surface smoothening/texturing or lamination within two substrates is executed simultaneously through thermomechanical treatment in a heated roll nip by melting the granular layer formed of the powdery film forming material.

A continuous development toward more compact surface treatment processes leads toward simultaneous treatment of both sides of the substrate and total on-line surface treatment. The dry surface treatment process provides additional possibilities to make the converting process even more compact by omitting the wetting-drying-cycles, solvent evaporation or melt processing encountered in conventional processes. The application and smoothening or lamination steps are integrated into one single process. Such a change provides possibilities to reduce both investment and production costs (e.g. overall efficiency, raw material and energy). It will also require changes in preparation and handling of the coating and adhesive raw materials.

The dry surface treatment process also adds possibilities to explore new converting product properties. This is achieved as a result of an eliminated rewetting of the base paper surface related to the suspension coating applications and shortened melt processing times related to the extrusion applications. The coating powder also stays on the substrate surface and e.g. with low coat weights (2-8 g/m$^2$) almost perfectly covers the surface without possibilities to penetrate or adsorb into the structure. A distinct interface between the film layer and the substrate can be observed in the cross-section of a dry-formed product.

The applied polymer can also be treated to form porous non-uniform layer, favored for example in some printing applications. The available materials could be e.g. inorganic and plastic pigments or highly absorptive polymers. There are possibilities for matte, glossy, transparent, colored and pigmented polymer-based surfaces and connecting layers. Inorganic pigments may be used as additives or to give extra value, e.g. if a more porous surface is favorable.

When producing the powdery film forming material for the dry surface treatment process, the materials can be prepared directly via the polymerization process or precipitation from suspension, and possibly refining by e.g. grinding. When preparing multicomponent powders, the components are combined or prepared separately either as dispersions in a liquid phase (e.g. water etc.), prior to entering an evaporation or drying process, in a gas phase (e.g. air etc.), or in a melt-mixing phase prior to granulation and grinding, as shown in table 1. Therefore, there are several methods available to produce, refine and combine the coating components.

Polymer materials applicable in powder form include thermoplastics such as polyamides (PA: Nylon-11 and Nylon-12, preferably high crystalline grades), polyolefins like polyethylene (PE-LD, PE-LLD, PE-HD, PE-MD), polypropylene (PP), and their copolymers, polyesters like poly(ethylene terephthalate) (PET) and poly(butylene terephthalate) (PBT), and others like poly(vinylidene chloride) PVDC, poly(tetrafluoroethylene) (PTFE), polyacetal (POM), ethylene-vinyl alcohol (EVOH), polyvinyl alcohol (PVOH), ethylene-vinyl acetate (EVA), polyvinyl butyral (PVB), acid copolymers, starch, ionomers, a selection of biodegradable polymers, and amorphous polymers like polystyrene (PS), acrylonitrile-butadiene-styrene (ABS), polyvinyl acetate (PVAc), polycarbonate (PC), poly(methyl methacrylate) (PMMA) and polyvinyl chloride (PVC) can be used. Available thermosetting polymers are e.g. epoxies and its blends, Formaldehydes and some polyesters. Grinding of sticky (low Tg) plastics may require cryogenic conditions.

The inorganic pigments include e.g. ground calcium carbonate, precipitated calcium carbonate, kaolin, calcined clay, talc, titanium dioxide, gypsum, alumina trihydrate and silica pigments. The amount of inorganic material in the powdery film forming material is 40 wt-% at the most, preferably 20 wt-% at the most and more preferably 12 wt-% at the most. It is possible that there is no inorganic material, and in some films manufactured according to the method of the invention it is advantageous if the granular layer is free from inorganic material. The mentioned possibilities of producing the powdery film forming material are summarized in table 1.

TABLE 1

Description of the possibilities for manufacturing and blending of the components of the powdery film forming material.

| Polymerization process | Dispersion medium | Physical state |
|---|---|---|
| High-pressure polymerization | Gas | Mechanical mixture of separate inorganic pigment and polymer particles<br>Blend particles of inorganic pigment and polymer(s) ground to powder |
| Polymerization in supercritical conditions | Gas | Separate inorganic pigment and polymer(s)<br>Hybrid of inorganic pigment with polymer(s) |
| Suspension Polymerization | Liquid | Separate inorganic pigment and polymer(s) particles<br>Hybrid particles of inorganic pigment and polymer(s) |

The formation of a uniform film layer requires powder melting, spreading and adhesion on the substrate surface. These are affected by e.g. thermal and pressure conditions, initial particle size, Theological properties of the melt, substrate roughness and chemical compositions (i.e. surface energies, bonding sites, multicomponent materials). When the materials require some kind of refining, the preparation process parameters require optimization to create a fine-sized and homogeneous powdery film forming material without forming strong aggregates in the dried or ground powder. These aggregates could, due to their large size, give an uneven and too porous film layer interfering the permeation properties. Polymer thermal deformability during thermomechanical treatment determines the layer properties such as density, openness, smoothness, strength and optical properties.

The particle properties directly influence the conditions during the initial powder application, which includes the fluidized bed during powder transport and electrostatic deposition as an initial adhesion. By grinding mm-scale polymer granulate particles, particles in the range 50-250 μm have been produced. Also the drying conditions of the material blends in suspensions have been found to greatly influence the particle size distribution of the coating powder. Aggregates in the range of 5-500 μm after spray drying and 1-100 μm after freeze-drying have been produced. The average aggregate or particle size can be further reduced when applying a certain post-grinding. Favorable particle size does not exceed 100 μm, but particles as small as a few nm can be used. It can be said that a particle size close to 10 μm would be preferable in respect to the charging properties but it depends on the powdery film forming material. The components of the powdery film forming material can have varying electrical properties such as particle surface charging and discharging rate.

A considerable reduction of the applied polymer amounts has been possible due to further optimized thermomechanical fixing conditions (e.g. dwell-time, surface temperature and linear load). Barrier coatings and adhesive layers produced by the dry surface treatment process can have an advantage from the lowest possible film weights. The applicable film weight in one application is 360 g/m$^2$, which corresponds to approx. 3-100 μm layer thickness with plastics. Powder fineness allows the application of thin film layers, and the formed layer homogenize with a feasibly low energy input in the thermomechanical treatment compared to that in the extruder mixing section.

It is advantageous if all the steps of the manufacturing process are made in dry conditions. For example, the powder components should be produced as dry or the preparation needs to be done in another carrier medium than water (e.g. air, another gas or an evaporable liquid). This is to be done to avoid the related costs and possible powder defects such as too strong agglomeration and large particle size.

The most profitable way could be preparation of dry powder components without the need for drying where the particle morphology is adjusted in the production process. Fine-sized polymer particles can also be formed by synthesis in a gas phase, for example in supercritical carbon dioxide (sc-$CO_2$). The separation of the solvent from product is simplified because $CO_2$ reverts to the gaseous state upon depressurization, thus eliminating energy intensive drying steps. The selection of suitable monomers is quite large, including combinations of styrene, butadiene, vinyls, acrylates, and olefinic monomers (typically emulsion, suspension, or bulk polymerized grades). The end product is a dry powder with a particle size between 0.2 and 10 μm readily recovered by venting $CO_2$.

In dry surface treatment process of miscellaneous converting substrates, the powdery film forming material for forming the granular layer is sprayed through an area of strong electric field and high free-ion concentration to the surface of the substrate. The powdery film forming material is put into the feeder chamber and transferred to the powder deposition unit with compressed air. The compressed air is used for many purposes such as powder fluidizing, transporting, and conditioning. As the complexity of the application equipment, the charging unit and the powdery film forming material properties vary, the importance of a continuous supply of clean and dry air also increases. The air quality (e.g. temperature and moisture variations) and powder piping can generate contaminants in the compressed air, which may cause process and quality problems. The contaminants in the compressed air can also consist of vapor, liquid or solids.

The powdery film forming material is charged in the powder deposition unit. A primary requirement for electrostatic powder deposition is generation of large quantities of gas ions for charging the aerosol particles. This is accomplished by means of a gaseous discharge or corona-treatment. The generation of a corona involves the acceleration of electrons to high velocity by an electric field. These electrons possess sufficient energy to release an electron from the outer electron shell when striking neutral gas molecules, thus producing a positive ion and an electron. This avalanche phenomenon is initiated around the discharge or corona electrode.

An electric field is created by the voltage application to the electrode pair. The electric field in the interelectrode space has three main purposes: (1) a high electric field near the electrode with a small radius of curvature leads to the generation of charging ions in an electrical corona, (2) the field provides the force that causes these ions to collide with and transfer their charge to the particles of the powdery film forming material, and (3) it establishes the necessary force to attach the charged particles of the powdery film forming material to paper. If the small radius electrode is negative (e.g. negative corona), electrons from the corona region move toward the grounded (e.g. positive) electrode and the positive ions move toward the negative electrode. To achieve a reversed polarity (positive corona), the positive ions move toward the grounded electrode and the electrons move toward the positive electrode with a small radius.

Instead of one-sided application of the powdery film forming material, also a two-sided application is possible. The two-sided application comprises a negative and positive corona used at the same time. As the electrode is negative (negative corona region), the electrons in the negative corona region move towards the positive electrode (positive corona) and the positive ions towards the negative electrode. On the opposite side of the substrate (positive corona region), the positive ions move towards the negative electrode and the electrons towards the positive electrode.

In the case of an excess supply of the powdery film forming material, the electrostatic deposition can also be utilized to remove it. The uncharged or charged powder excess, which floats in the deposition unit can be charged with secondary electrodes. Then the powder collection can be done for example through electrostatic precipitation or air suction.

The powdery film forming material can be precharged with triboelectric charging, corona charging, or charged in situ. Precharging strengthens the impact of the electric field on the powder.

The powdery film forming material is supplied to the application unit with compressed air or another transport medium that promotes particle charge. The transport medium can be added to the supply air e.g. through oxygen addition or entirely replace the supply air by another gas. Also the moisture content and the temperature of the supply air can be varied to improve the charging effect in the corona region. This might further improve the powder transfer in the electric field to the substrate surface. A higher temperature of the supply air increases the ionization coefficient. The supply air temperature should not influence the properties of the powdery film forming material, it should not exceed the polymer glass transition or melt temperature ($T_{air}<T_g$, $T_m$ of the polymer) and result in powder agglomeration. The moisture content of the supply medium is to be kept below a relative humidity (RH) of 50% to avoid discharges and raise the medium pressure beyond 0.1 bar. This decreases the amount of harmful discharge. The powder stream can be parallel or directed perpendicular to the web. The parallel powder stream can also be used to overcome the air boundary layer. As the powder is accelerated to the same velocity as the web, the electrostatic forces may be used to pull the web and the particles together. The powder deposition can also be made by using a dielectric belt and an electric field. In a multilayer deposition, the powder components are deposited separately or as powder blends. The grounding electrode geometry can then be either a platy stationary electrode or a circular rotating electrode (e.g. operating as a belt or as a roll).

Voltage and current are varied with the required distance between the charging and the grounding electrodes, the material properties (e.g. dielectric constants) of the electrodes, the powder composition (resistivity, dielectric constants of the powder etc.), the powder amount, the supply medium moisture content and pressure. The voltage varies from 5 kV to 1000 kV and the current from 30 μA to 1000 A. The powder properties and the application concept (one-sided or two-sided) guides set-up of the charging electrodes. The charging electrodes are however either positive or negative.

Another possibility to charge the particles of the powdery film forming material is to use a system producing triboelectric charges. The particles are charged in contact with another material, and the strength of charging is adjusted e.g. by materials contacting each other, or the time the materials are in contact with each other. The triboelectric charging depends strongly on the properties of the contacting materials, and it can be evaluated for example by utilizing suggestive triboelectric series. The surface properties of the powdery film forming material can, however, be modified in different ways, for example by forming a thin surface layer on the particles of the film forming material. This can effectively be used to change the triboelectrification properties of the material.

It is also possible to combine both corona charging electrodes and a system for producing triboelectric charges in a same device.

Instead of the sheet-like substrate on which surface a granular layer is formed, a substantially planar surface can be used. The planar surface is a part of the film forming machine, such as an endless belt. A granular layer is formed on the belt, the granular layer is finished to form a film, and the film is peeled off from the belt after cooling the film. The film may be orientated by a suitable manner, for example by stretching. Such a film forming process can be used for example instead of the extrusion process.

After forming the granular layer on the surface of the substrate, the granular layer is finished to form a film. The finished film is substantially free from pinholes. The powder melting and fixing is accomplished in a thermomechanical treatment with an optimal combination of temperature (80-350° C.), linear load (15-450 kN/m) and dwell time (0.1-1000 ms; speed 150-1200 m/min; nip length 3-1000 mm). The reinforced fixation can be used in different ways to achieve desired properties. The thermomechanical treatment can be made by conventional calendering methods or calendering-like methods. The conventional calendering methods include hard-nip, soft-nip, long-nip (e.g. shoe-press), condebelt and super-calendering. One of the most essential parts in the thermomechanical fixing is the non-adhesive property of the contacting roll surfaces to avoid blocking, sticking or other build-up of polymer based deposits. When powders with a low polymer content (<20 pph) are used, hard metal or PTFE-based roll cover materials are suitable. When powders with a high polymer content (>20 pph) are used, the roll cover must have better non-sticking properties, e.g. usage of PTFE-based covers is preferred.

It is possible to chill the film after the thermomechanical finishing step. The chilling rate of the dry surface treated product can be controlled, so the rate and degree of polymer crystallization can be modified. This affects e.g. the barrier properties.

In some cases, the increased surface moisture content of the substrate improves the powder deposition and fixing on the surface. An incoming substrate moisture content (e.g. hydrophilic film bulk moisture) can be adjusted to optimize the layer strength and other product properties. For example, starch requires a higher moisture content than hydrophobic polymers to reach equivalent binding strengths. This can be explained by the need to solubilize the starch to improve deformability and give binding properties but then an excess energy is required for water evaporation. The surface moisture can also be adjusted through nozzle application onto the substrate surface. Then only a water amount evaporating in the fixing process is applied and the moisture balance over the fixing stage remains constant. The nozzle application can be done before the powder application or the thermomechanical fixing.

Several applied layers and double-sided coatings can be produced on the same line. In multilayer application of powders the separation of layers is maintained due to the electric repulsive forces. The preceding layer can, but does not have to be fixed before applying the next. To ensure adhesion between the applied layers, some degree of interlayer diffusion should occur during fixation.

Low processing temperatures are possible due to the mechanical load in the nip(s). Therefore the range of processable materials broadens into more temperature-sensitive grades and high molecular weight polymers. High molecular weight polymers have improved mechanical properties but often problems in processability due to their rheological character. Shorter melt processing reduces the risk of over-oxidation, found harmful e.g. in heat sealing.

In conventional extrusion the layer thickness is controlled by the screw speed (output rate), die gap, draw ratio and linear load of the chilling nip. Profile control in dry surface treatment (both in the machine direction and the cross direction) will be simplified and possibly quickened by electrostatic application. In multilayer application, not all the layers have to be the same width. There is a possibility to form bands of the powdery film forming material, advantageous for example in converting products to be seamed. Another possibility to utilize the partial film layer is to form bands from a material, which reacts to different gaseous substances for example by changing its color. When such a layer is an inner layer of a packaging material, the layer will react for example to oxygen penetrating inside the package after it is damaged or a layer can be reactive with the overlying printing ink indicating a broken structure when the two materials are in contact. The above-mentioned layer can also be between the layers forming the packaging material but then it is advantageous if the film is substantially continuous.

There are various uses for the films produced by the dry surface treatment process. Polymer-based film layers have a wide variety of functions. Impermeable structures are formed by so-called barrier coatings and barrier sealing layers. Different materials work as barriers for liquids, vapors, gases and light (e.g. water, steam, oxygen, flavors and oils). Typically a combination of materials gives the best result and often one material has several functions. The successive layers must be chosen so that the overall structure acts as a two-way barrier (prevents leakage or permeation from the outside to the inside or vice versa). The layer must be free from pinholes, compositional and physical irregularities and possess good adhesion to the substrate layer. Connective layers of adhesives are used to form the bonding layer between webs in extrusion lamination or in a separate process (e.g. dry lamination).

Specified heat sealing materials are used in converting products to be folded or/and seamed to different shapes. In some applications the seam must be peelable. Low sealing temperature and high hot-tack (strong adhesion as a melt) of the adhesive are favorable for less energy-intensive and fast sealing operation. Polymer-based coatings are used for mechanically improved protective surfaces, over-print lacquering and surface waxing. For example, polyethylene-based waxes are suitable for use in the process of the invention. They provide protection against mechanical loads, improved lubrication and appearance. In addition, metal surfaces may require a sealing layer to prevent oxidation.

Often the converting process includes also printing. Depending on the printing process, the substrate meets the requirements of e.g. absorption (porosity), and resistance against abrasion, moisture, solvents and heat. In some applications the surface requires an over-print protective coating.

Required mechanical properties of a coated or laminated product include e.g. bending strength (no delamination or cracking), abrasion and impact resistance and durability of the barrier properties under mechanical and environmental loading with the passage of time. For some applications the optical and electrical properties of the products should be able to modify.

The method of the invention is suitable for forming e.g. food packaging products. Characteristic properties of the packaging products are a low oxygen transmission rate and a low water vapor transmission rate. According to DIN 3985, the oxygen transmission rate is generally at the most 180 $ml/m^2/24$ h (23° C., RH 0%), and the water vapor transmission rate is generally at the most 2.5 $g/m^2/24$ h.

Many products produced according to the present invention comprise the following layers: A printing layer on the reverse side of the plastic layer, an adhesive layer to attach successive layers to each other, and a metal layer composed of a metal foil or a metal coating on a plastic or paper layer.

The prerequisite for forming the granular layer from the powdery film forming material is a continuous substrate onto the granular layer can be formed. One of the layers forming the final product acts as a basic material, and the other layers can be formed on it. The basic material needs not to be the outer or inner layer of the packaging material but it can also be some interlayer. The two-sided process is advantageous when films are formed on the both surfaces of the basic material. It is possible that even the basic material have been formed in a previous process step by the dry surface treatment process.

BRIEF DESCRIPTION OF THE DRAWINGS

In the following, the dry surface treatment process will be described by examples and a drawing in which the principal of the utilization of the one-sided dry surface treatment process is shown.

DESCRIPTION OF THE PREFERRED EMBODIMENTS

A sheet-like substrate is unwound from a reel 1. An electric field 4 is formed between a negative electrode comprising a feeding nozzle 3 and a grounding electrode 8. To attain an even electric field, extra negative electrodes 2 are placed in the same row with the electrode by the feeding nozzle 3 to strengthen the performance of the electrode 3.

A grounding electrode 8 is on the reverse side (compared to the negative electrodes) of the substrate to be treated. The substrate is preferably in a continuous form. The grounding electrode 8 can be a stationary plate, or it can be a rotating roll. The rotating roll is advantageous because the stationary plate tends to create uneven granular layers.

Air is led to the process by a compressor 7. A powdery film forming material is conveyed through a fluidized bed 6 and through a valve 5 to the negative electrode comprising the feeding nozzle 3. Charged particles of the powdery film forming material are blown from the feeding nozzle towards the substrate. The particles form a granular layer on the substrate which is finished in the next process step.

The substrate is led to a nip formed between two counter rolls 9, 10. The roll 9 maybe a resilient roll and the roll 10 may be a hard heated roll. The granular layer is melted in the nip to form an even substantially impermeable film. A ready product is wound to the reel 11.

EXAMPLE

Several alternatives for packaging materials are listed below. The alternatives are represented as there are made by the conventional technique and layers which are possible to be formed by the dry surface treatment technique are marked with *. Depending on the chosen basic material, also other possibilities for forming a layer by the dry surface treatment process may exist.

1. Caps or lids for e.g. pet food packaging:
   a polyester layer
   a printing layer
   an adhesive layer (PE, PP, Surlyn)*
   a metal coating or a metal layer
   a polyethylene layer*
2. A packaging material for wafers is composed of the following layers:
   a polyester layer
   a printing layer
   an adhesive layer *
   a metal coating or a metal layer
   co-extruded oriented polypropylene layer *
3. A packaging material for snacks or Pommes frites is composed of the following layers:
   co-extruded oriented polypropylene layer
   a printing layer
   an adhesive layer *
   a metal coating or a metal layer
   co-extruded oriented polypropylene layer *
4. A packaging material for snacks and biscuits is composed of the following layers:
   a release layer *
   an orientated polypropylene layer
   an adhesive layer *
   a printing layer
   a metal coating or a metal layer
   a polyester layer *
   a cold sealable layer *
5. A packaging material for snacks and ice-cream is composed of the following layers:
   a release layer *
   a printing layer
   a metal coating or a metal layer
   an oriented co-extruded polypropylene layer *
   a cold sealable layer *
6. A packaging material for chocolate biscuits and wafers is composed of the following layers:
   a polyester layer
   a printing layer
   an adhesive layer *
   a metal coating or a metal layer
   a PVDC coating layer *
   an oriented polypropylene layer*
   an acrylic coating layer*
7. A packaging material for biscuits is composed of the following layers:
   an anti-scratch coating layer *
   a printing layer
   a paper layer (calendered)
   a metal coating or a metal layer
   an oriented co-extruded polypropylene layer*
8. A packaging material for high-quality biscuits is composed of the following layers:
   a polyester layer
   a printing layer
   an adhesive layer *
   a paper layer (calendered)
   an adhesive layer *
   a metal coating or a metal layer
   an oriented co-extruded polypropylene layer *
9. A packaging material for detergents is composed of the following layers:
   a polyester layer*
   a printing layer
   an adhesive layer *
   a polyethylene layer *
10. A packaging material for ham and cheese is composed of the following layers (the product is between the upper and lower layer):

The upper layer:
   a polyester layer with a PVDC coating as an outer surface
   a printing layer
   an adhesive layer *
   a polyethylene layer The lower layer:
   a polyethylene layer *
   an adhesive layer
   a polyamide layer *
11. A packaging material for coffee and milk powder is composed of the following layers:
   a polyester layer
   a printing layer
   an adhesive-layer *
   a polyethylene layer
   a metal coating or a metal layer
   an adhesive layer *
   a polyethylene layer *
12. A packaging material for nuts and dry fruits is composed of the following layers:
   an acrylic coating layer *
   a polypropylene layer
   a PVOH coating layer *
   a printing layer
   an adhesive layer *
   a white polyethylene layer *

13. A peelable packaging material for example for lids of yogurt cans is composed of the following layers:

a polyester layer * a printing layer an adhesive layer * a polyester layer * a layer of peelable material *

The invention claimed is:

1. A method for forming a film on a continuous or endless planar surface, comprising the steps of:

moving the continuous or endless planar surface between a row of electrodes and a backing electrode which are located at opposite sides of the continuous or endless planar surface and are at different potentials;

supplying pre-charged powdery particles to a feeding nozzle, the feeding nozzle forming an electrode in a position laterally spaced from and between extra electrodes to form the row of substantially in a plane electrodes and blowing the pre-charged particles from the feeding nozzle toward the continuous or endless planar surface and depositing onto the continuous or endless planar surface a layer of the pre-charged powdery particles of average size less than 100 μm containing less than 40wt-% inorganic additives to form a granular layer, wherein the particles are applied to the continuous or endless planar surface by the powder deposition unit utilizing an electric field created by the row of electrodes formed by the feeding nozzle and the extra electrodes; and finishing the granular layer in a calender with at least one heated member contacting the granular layer, to form a first film.

2. The method for forming a film of claim 1, wherein the at least one heated member contacting the granular layer is a roll.

3. The method for forming a film of claim 1, further comprising the step of: peeling the film off from the continuous or endless planar surface.

4. The method for forming a film of claim 1, wherein the continuous or endless planar surface is a paper web.

5. The method for forming a film of claim 1 wherein the continuous or endless planar surface is a paper web; and further comprising the steps of:

moving the continuous paper web at 150 to 1,200 meters per minute between the electrodes which are located at opposite sides of the web and are at different potentials and past the electrostatic powder deposition unit;

depositing onto the web the layer of electrically charged thermoplastic powdery particles of average size less than 100 μm containing less than 40 wt-% inorganic additives to form the granular layer wherein the granular layer has a weight of 3-60 g/m$^2$, wherein the particles are charged and applied to the continuous paper web by the powder deposition unit utilizing an electric field created by the electrodes; and finishing the web with the granular layer in the calender with at least one heated member contacting the granular layer, to form a first film which is 3-100 μm thick.

6. The method for forming a film of claim 5, wherein the at least one heated member contacting the granular layer is a roll.

7. The method of claim 5, wherein the electrodes at the opposite sides of the web comprise either:

a pair of a positive electrode and a negative electrode; or a negative or a positive electrode and an earthing electrode.

8. The method of claim 5, wherein a second film is formed on a side of the paper web opposite the first film by a process which is the same as used to form the first film.

9. The method of claim 7, wherein the second film is formed on the side of the paper web opposite the first film at the same time as the first film is formed.

10. The method of claim 5, wherein the powdery particles are carried to the web in a gaseous flow.

11. The method of claim 5, wherein the powdery particles are charged by corona charging electrodes.

12. The method of claim 5, wherein the powdery particles are charged by a system using triboelectric charging.

13. The method of claim 5, wherein the powdery particles are charged by using both corona charging electrodes and a system using triboelectric charging.

14. A method for forming a film on a continuous paper web or board, comprising the steps of:

pre-charging particles of a dry powder within a charging unit;

supplying the pre-charged particles from the charging unit to negatively charge a feeding nozzle which forms an electrode and blowing the pre-charged particles from the feeding nozzle toward the paper or board web, the feeding nozzle being positioned between negatively charged electrodes producing corona discharges, wherein the negatively charged electrodes are positioned outside of the charging unit and laterally spaced from the feeding nozzle, so that the negatively charged electrodes and the feeding nozzle form a row substantially in a plane, wherein the negatively charged electrodes arranged to attain an even electric field with the electrode formed by the feeding nozzle; and wherein the paper or board web is backed by a grounding electrode at a potential which is lower than or opposite to the potentials of the feeding nozzle, and the negatively charged electrodes producing corona discharges.

15. The method of claim 14 wherein the grounding electrode is a stationary platy electrode.

* * * * *

UNITED STATES PATENT AND TRADEMARK OFFICE

CERTIFICATE OF CORRECTION

PATENT NO. : 7,288,291 B2
APPLICATION NO. : 10/507437
DATED : October 30, 2007
INVENTOR(S) : Juha Maijala et al.

It is certified that error appears in the above-identified patent and that said Letters Patent is hereby corrected as shown below:

On the patent's front page under the heading "References Cited", patent no. 3,521,558 should be to --Fisher et al.--

On the patent's front page under the heading "References Cited", patent no. 3,549,403 should be to --Williams et al.--

In column 6, line 29 of the issued patent, "360 g/m2" should be --3–60 g/m2--

In column 13, lines 18 and 19 of the issued patent, "substantially in a plane electrodes" should be --electrodes substantially in a plane--

Signed and Sealed this

Fourth Day of March, 2008

JON W. DUDAS
*Director of the United States Patent and Trademark Office*